US011691306B2

(12) United States Patent
Bozikis et al.

(10) Patent No.: US 11,691,306 B2
(45) Date of Patent: Jul. 4, 2023

(54) RAZOR CARTRIDGE

(71) Applicant: BIC Violex S.A., Anoixi (GR)

(72) Inventors: Ioannis Bozikis, Athens (GR); Georgios Zografos, Attiki (GR)

(73) Assignee: BIC Violex Single Member S.A., Anoixi (GR)

( * ) Notice: Subject to any disclaimer, the term of this patent is extended or adjusted under 35 U.S.C. 154(b) by 321 days.

(21) Appl. No.: 16/940,609

(22) Filed: Jul. 28, 2020

(65) Prior Publication Data

US 2021/0031389 A1 Feb. 4, 2021

(30) Foreign Application Priority Data

Jul. 31, 2019 (EP) ..... 19189462

(51) Int. Cl.

| | |
|---|---|
| ***A45D 27/22*** | (2006.01) |
| ***B26B 21/40*** | (2006.01) |
| *B26B 21/44* | (2006.01) |
| *B26B 21/52* | (2006.01) |

(52) U.S. Cl.

CPC ..... *B26B 21/4031* (2013.01); *A45D 27/225* (2013.01); *B26B 21/4018* (2013.01); *B26B 21/443* (2013.01); *B26B 21/521* (2013.01)

(58) Field of Classification Search

None

See application file for complete search history.

(56) References Cited

U.S. PATENT DOCUMENTS

| | | | | |
|---|---|---|---|---|
| 6,041,926 | A * | 3/2000 | Petricca | B26B 21/521 30/40.2 |
| 6,295,734 | B1 * | 10/2001 | Gilder | B26B 21/4031 30/50 |
| 10,144,142 | B1 * | 12/2018 | Squires | B26B 21/42 |
| 11,059,193 | B2 * | 7/2021 | Bozikis | B26B 21/4068 |
| 2008/0256802 | A1 | 10/2008 | O'Connor | |
| 2009/0083982 | A1 | 4/2009 | Forsdike | |

(Continued)

FOREIGN PATENT DOCUMENTS

| | | | |
|---|---|---|---|
| EP | 3375578 | A1 | 9/2018 |
| EP | 3 771 532 | A1 * | 2/2021 |

(Continued)

*Primary Examiner* — Hwei-Siu C Payer

(74) *Attorney, Agent, or Firm* — Bookoff McAndrews, PLLC

(57) ABSTRACT

A razor cartridge comprising a housing extending along a longitudinal axis. The housing comprises a leading longitudinal side and a trailing longitudinal side. A cutting member mounting portion provided in between the leading longitudinal side and the trailing longitudinal side. Three or more substantially parallel cutting members are disposed in the cutting member mounting portion in a shaving direction of the razor cartridge. At least one of the three or more cutting members comprises a blade support. The blade support comprises a blade mounting portion disposed on an inner surface of the respective blade support that, in use, faces away from a shaving plane. A blade attached to the blade mounting portion. The cutting members are disposed to define a plurality of inter-blade spans between cutting edges of the blades. The trailing longitudinal side of the housing does not comprise a skin care element.

19 Claims, 10 Drawing Sheets

(56) References Cited

U.S. PATENT DOCUMENTS

| | | | | |
|---|---|---|---|---|
| 2010/0175265 | A1* | 7/2010 | Bozikis | B26B 21/227 30/526 |
| 2011/0146079 | A1* | 6/2011 | Clarke | B26B 21/4012 30/34.05 |
| 2014/0026424 | A1* | 1/2014 | Oglesby | B26B 21/4031 30/50 |
| 2014/0259677 | A1 | 9/2014 | Coresh | |
| 2020/0398449 | A1* | 12/2020 | Claus | B26B 21/4031 |
| 2021/0031389 | A1* | 2/2021 | Bozikis | B26B 21/4031 |

FOREIGN PATENT DOCUMENTS

| | | | |
|---|---|---|---|
| WO | WO 95/09071 | A1 | 4/1995 |
| WO | WO 2006/027018 | A1 | 3/2006 |
| WO | WO 2007/147420 | A1 | 12/2007 |
| WO | WO 2012/158141 | A1 | 11/2012 |
| WO | WO 2014/119808 | A1 | 8/2014 |

* cited by examiner

RAZOR CARTRIDGE

CROSS-REFERENCE TO RELATED APPLICATION

This application claims benefit from European patent application EP19189462.5, filed on 31 Jul. 2019, the entirety of which is incorporated herein by reference.

TECHNICAL FIELD

The embodiments described in the following disclosure relate to a razor cartridge, a method for manufacturing a razor cartridge, a shaving razor assembly and an associated kit of parts.

BACKGROUND

Razor cartridges (also known as safety razor cartridges) are permanently or removably attached to a razor handle that, in use, is oriented in shaving direction. Razor cartridges typically comprise one or more cutting members, each supporting a blade, mounted perpendicular to the shaving direction. Razor cartridges are also typically provided with a guard (at a leading longitudinal side of the razor cartridge in the shaving direction) and a cap (at a trailing longitudinal side of the razor cartridge in the shaving direction).

A skin care element, such as a lubricating element, is also conventionally provided at the trailing longitudinal side so that in use, the skin care element deposits a lubricant on the skin of a user to improve the glideness when shaving. In use, a user holds the razor handle in the shaving direction and brings the razor cartridge and the skin care element into contact with a portion of skin defining a cutting edge plane.

Typically, the cutting edge plane is defined as the plane intersecting the first and second skin contact areas of, for example, cutting edges of the shaving head. Movement of the razor handle by the user during shaving operation causes the blades of the razor cartridge to be moved across the cutting edge plane in the shaving direction, enabling the blades to remove unwanted hair.

The performance of razor cartridges may be further improved.

SUMMARY

According to a first aspect, there is provided a razor cartridge. The razor cartridge comprises:

a housing extending along a longitudinal axis, wherein the housing comprises a leading longitudinal side and a trailing longitudinal side, and a cutting member mounting portion provided in between the leading longitudinal side and the trailing longitudinal side; and three or more substantially parallel cutting members disposed in the cutting member mounting portion in a shaving direction of the razor cartridge;

wherein at least one of the three or more cutting members comprises a blade support, wherein the blade support comprises a blade mounting portion disposed on an inner surface of the respective blade support that, in use, faces away from a shaving plane or shaving surface, and a blade attached to the blade mounting portion, wherein the cutting members are disposed to define a plurality of inter-blade spans between cutting edges of the blades; and wherein the trailing longitudinal side of the housing does not comprise a skin care element.

In embodiments, each of the three or more cutting members comprises a blade support, wherein the blade support comprises a blade mounting portion disposed on an inner surface of the respective blade support that, in use, faces away from a shaving plane or shaving surface, and a blade attached to the blade mounting portion, wherein the cutting members are disposed to define a plurality of inter-blade spans between cutting edges of the blades; and wherein the trailing longitudinal side of the housing does not comprise a skin care element.

In embodiments, the trailing longitudinal side of the housing does not comprise a lubrication element.

In embodiments, the housing of the razor cartridge, when in use, is configured to direct contact with the skin of a user.

According to a second aspect, there is provided a razor cartridge. The razor cartridge comprises:

a housing extending along a longitudinal axis, wherein the housing comprises a leading longitudinal side, a trailing longitudinal side, and a cutting member mounting portion provided in between the leading longitudinal side and the trailing longitudinal side; and three or more substantially parallel cutting members disposed in the cutting member mounting in a shaving direction of the razor cartridge;

wherein at least one of the cutting members comprises a blade support, wherein the blade support comprises a blade mounting portion disposed on an inner surface of the respective blade support that, in use, faces away from a shaving plane or shaving surface, and a blade attached to the blade mounting portion, wherein the cutting members are disposed to define a plurality of inter-blade spans between cutting edges of the blades; and wherein a span defined between the rearmost portion of the substantially parallel cutting member that is closest to the trailing longitudinal side and the rearmost portion of the trailing longitudinal side of the housing is less than 2.35 mm.

According to a third aspect, there is provided a method of manufacturing a razor cartridge according to a third aspect. The method comprises:

obtaining a housing extending along a longitudinal axis, wherein the housing comprises a leading longitudinal side, a trailing longitudinal side, and a cutting member mounting portion provided in between the leading longitudinal side and the trailing longitudinal side;

obtaining three or more substantially parallel cutting members; and assembling the housing and the three or more substantially parallel cutting members in the cutting member mounting portion of the housing between the leading longitudinal side and the trailing longitudinal side of the razor cartridge in a shaving direction of the razor cartridge;

wherein at least one of the cutting members comprises a blade support comprising a blade mounting portion disposed on an inner surface of the respective blade support that, in use, faces away from a shaving plane or shaving surface, and a blade attached to the blade mounting portion, wherein the cutting members are disposed to define a plurality of inter-blade spans between cutting edges of the blades; and wherein the housing does not comprise a skin care element, or wherein a span defined between the rearmost portion of the trailing longitudinal side of the housing and the rearmost portion of the substantially parallel cutting member that is closest to the trailing longitudinal side is less than 2.35 mm.

According to a fourth aspect, there is provided a shaving razor assembly.

The shaving razor assembly comprises a razor handle and a razor cartridge according to the first or second aspects, or its embodiments discussed herein, wherein the razor cartridge is either releasably attached to the razor handle via a pivotable or non-pivotable connection, integrally formed with the razor handle via a non-pivotable connection, or integrally formed with the razor handle via a pivotable connection.

According to a fifth aspect, there is provided a kit of parts. The kit of parts comprises:

a razor handle and/or a razor cartridge holder comprising a plurality of razor cartridges razor cartridge according to according to the first or second aspects, or its embodiments discussed herein.

Further embodiments are presented in the dependent claims, and the detailed description, to which the reader should now refer.

As a result of these improvements, the skin care element (typically a lubricating strip) that is conventionally included with a razor cartridge is not required structural changes to the razor cartridge to be detailed subsequently remove the requirement for a skin care element such as a lubricating strip. The overall width of the razor may be reduced, improving the amount of precision possible because there is no additional element in the trailing longitudinal side.

In conventional razor cartridges with three or more blades, the inter-blade span is typically measured to be constant in a range of about 1.05 to 1.5 mm (when the razor blade is mounted on top of the blade support, i.e. on a surface of the blade support that in use faces towards the shaving plane or the shaving surface). A common drawback of conventional shaving heads with movable cutting elements with the blades on top of the support is that aggressive shaving, resulting in nicks and cuts, and an increased sense of irritation. In these conventional razors, the skin has to be supported by the blade cutting edges on their own. This provides the skin with a relatively small surface to be supported on during shaving, thus causing the so-called bulging effect. At the same time, to reduce or to limit the bulging effect and to reduce nicks and cuts, the distance between two consecutive cutting edges (the inter-blade span IBS) has to be narrow (1.05-1.5 mm) A narrow inter-blade span results in low levels of rinsability, since the shaving debris (such as hair or foam) are blocked in-between the cutting elements.

An effect of a razor cartridge according to the first aspect is that the phenomenon of skin bulge between cutting members attached to a blade mounting portion is reduced, because there are more (double) points of contact for the same number of blades (compared to a prior-art cartridge with the same number of blades). In products marketed at the moment, the presence of a lubricating strip containing a water-soluble material to enhance glideness during shaving appears to be a pre-requisite in order to avoid the drawbacks of low glideness and high drag forces.

At least one cutting member is configured so that it has two contact areas with the cutting edge plane, namely the cutting edge of a blade mounted on the cutting member, and a distal portion of the support member that the blade is mounted on. A conventional cutting member has one skin contact area per cutting member (the cutting edge of a blade provided on the conventional cutting member).

The extra skin contact point provided, for example, by the rounded edge of the blade support when the first blade is mounted closer to the leading longitudinal side of the razor cartridge equalises the distribution of the drag forces exerted by the skin against the razor cartridge, and thus mitigates irritation, nicks, and cuts during shaving.

Further, the bulging of skin between the cutting edges of the blades is reduced because an additional skin contact area provided by the blade support of at least one cutting member of the razor cartridge according to the first aspect allows for an increased inter-blade span while it reduces the effective distance between skin contact points. This is due to the provision of additional skin contact points that provides for intermediate contact points in-between the inter-blade spans of the plurality of cutting members (i.e. the cutting edges of consecutive blades).

By not incorporating a skin care element, the assembly process for the cartridge is simpler, and there is a lower bill of materials. In addition, the omission of a skin care element enables a razor cartridge to be provided that is around 2 millimeters narrower (in the direction transverse to the longitudinal direction of the razor cartridge) than a razor cartridge comprising a skin care element. Therefore, a razor cartridge having a higher packing density is provided. Alternatively, the razor cartridge is able to accommodate one more blade compared to designs that require the use of a skin care element and with large inter blade span, IBS (i.e. without clogging).

The present razor cartridge may, in particular, be more suited to infrequent razor users who wait several days between shaving. Such behaviour leads to a requirement for a greater degree of hair removal compared to the case of a user who shaves daily. A razor cartridge according to the present disclosure is better adapted to e.g. users who shave less frequently, because the wear rate of blades at the leading longitudinal edge of the razor cartridge can be equalised with the wear rate of blades at the trailing longitudinal edge of the razor cartridge to accommodate the denser and/or longer hair clippings characteristic of users who shave less frequently.

A cutting edge plane is defined as the plane intersecting the first and second skin contact areas of, for example, cutting edges of the shaving head (in a two-dimensional cut-through, the cutting edge plane would be a line intersecting the cutting edges of the blades).

A shaving plane is typically defined by the most prominent members of the housing of a razor cartridge. For example, the shaving plane is defined as the plane between a guard member and a cap member that contact a user, in use. The shaving plane represents the theoretical position of the surface being shaved. Based on that, an exposure (of the cutting edge plane with respect to the shaving plane) can be designated as negative, neutral or positive. A negative exposure implies that the cutting edge plane is nearer to the base support member of the razor cartridge than the shaving plane. A positive exposure implies that the cutting edge plane is further from the base support member compared to the shaving plane.

One type of cutting member discussed herein comprises blades mounted on a surface that in use faces away from the shaving plane or shaving surface i.e. below their blade support, as defined and illustrated subsequently. In this case, a local exposure is designated as the vertical distance between a cutting edge and a support plane of the cutting member, wherein the support plane is defined by a tangential line intersecting the tips of the blade supports.

In examples, the present razor cartridge may be combined with inter-blade spans falling between 1.6 to 2.2 mm, without the need to provide a skin care element in any location on the razor head, and in particularly on a trailing longitudinal side of the razor head.

In an embodiment having four blades, the inter-blade span between the first two blades is larger compared to the inter-blade span of the second to the third blade, and of the third to the fourth blade. With this configuration, the first two blades that cut the highest amount of hair are separated enough to ensure that the debris will flow away easily between the blades, whilst the rest of the blades have a narrow inter-blade span to reduce the risk of nicks and cuts. However, a skilled person will appreciate that many other possible combinations of blade configuration are possible.

Furthermore, the final blade (closest to the trailing longitudinal side) can be used substantially as a precision blade or at least more precision can be achieved using the final blade of the razor cartridge than when a skin care element is present.

BRIEF DESCRIPTION OF THE DRAWINGS

Other characteristics will be apparent from the accompanying drawings, which form a part of this disclosure. The drawings are intended to further explain the present disclosure and to enable a person skilled in the art to practice it. However, the drawings are intended as non-limiting examples. Common reference numerals on different figures indicate like or similar features.

DETAILED DESCRIPTION

Figure 1:
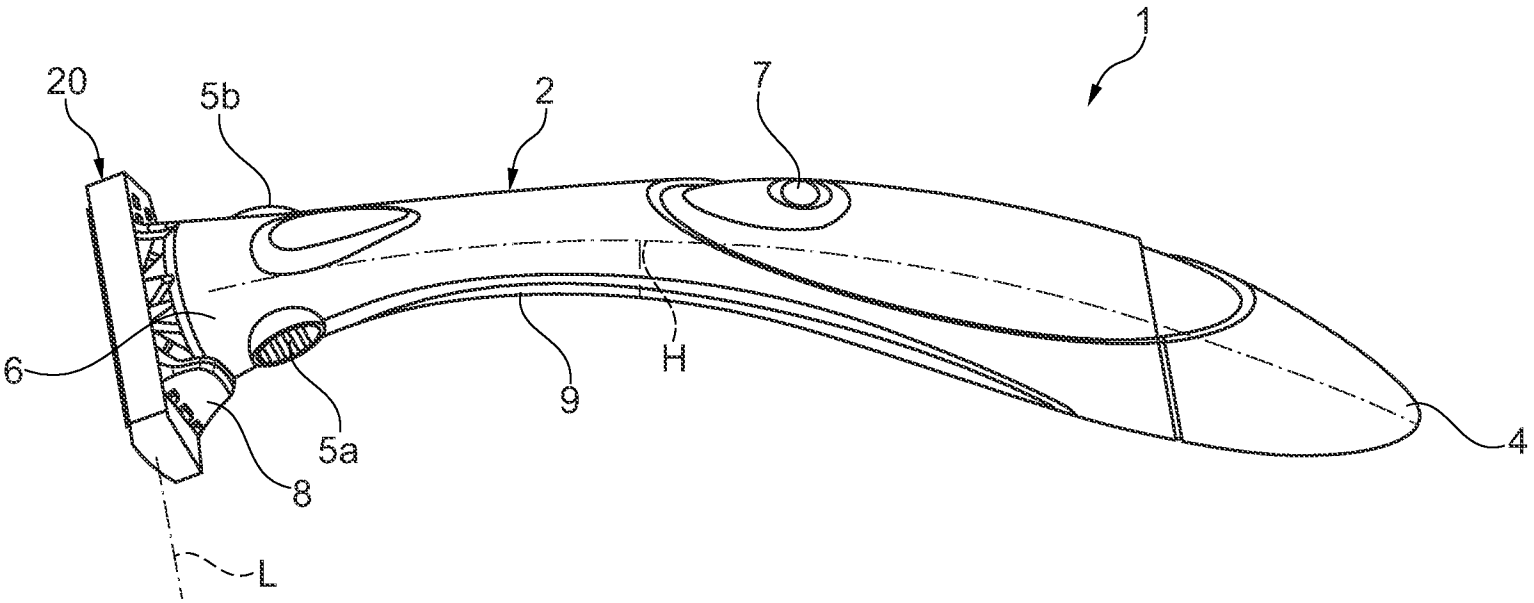
FIG. 1 shows a perspective view of a shaving razor assembly.

FIG. 1 is a perspective view of a shaving razor assembly 1 according to an aspect. The shaving razor assembly comprises blades which are not driven by a motor. The shaving razor assembly 1 comprises a handle 2 extending in a handle direction H between a proximal portion 4 and a distal portion 6 of the handle 2. A razor cartridge 20 is mounted at the distal portion 6 of the handle 2. The razor cartridge 20 will be presented in more detail following discussion of the shaving razor assembly 1.

The mounting of the razor cartridge 20 to the distal portion 6 of the handle 2 in the illustration is via a pivotable bearing member 8 enabling a frame of reference of the handle 2 to vary relative to a frame of reference of the razor cartridge 20, to thus enable the angle of the razor cartridge against the skin of a user to vary and adapt to changes during use.

In particular, the razor cartridge 20 pivots relative to the handle 2 about the longitudinal axis L of the razor cartridge 20, in use. The pivoting enables the user to adapt to contours of the body, for example. The longitudinal axis L of the razor cartridge 20 is substantially perpendicular to the shaving direction along the handle 2. Another example of a connection mechanism for connecting the razor cartridge 20 to the handle 2 is discussed in WO2006/027018 A1. Another alternative is a razor cartridge 20 that may pivot relative to a second pivot axis (a rocking axis), substantially perpendicular to axis L. In examples, the pivotable bearing member 8 may be omitted (not illustrated) and the handle 2 provided as an integrally connected part of the support of the razor cartridge 20. In an example, the pivotable bearing member 8 may further comprise, or be replaced by, a release mechanism 5*a*, 5*b*, enabling rapid release of an exhausted razor cartridge from the handle 2.

In an example, the handle 2 and the support of the razor cartridge 20 are integrally formed with a pivotable bearing member (not illustrated) such as a plastic spring member.

In an example, the handle 2 is provided with a handle grip 9 formed of a rubber, or rubber-like material to improve gripping friction. In an example, the handle is provided with a thumb-rest 7 to enable a more secure grip of the handle 2 by a user.

Figure 2A:
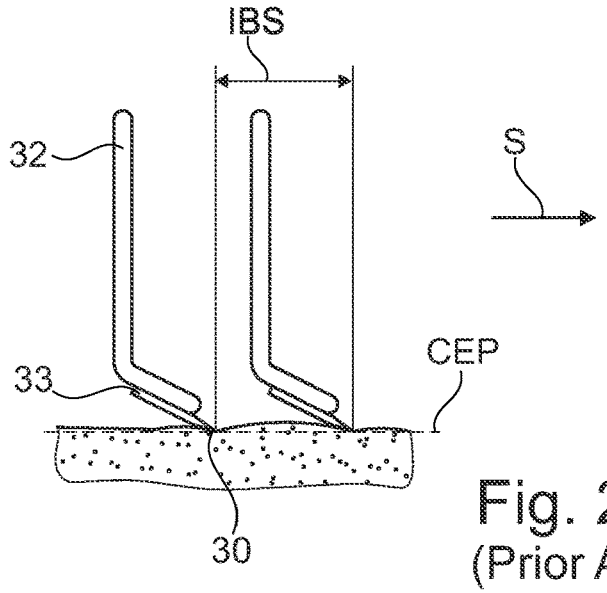
Fig. 2a (Prior Art)
FIGS. 2*a* and 2*b* show schematic side views of a portion of a prior art razor cartridge in use.
Figure 2B:
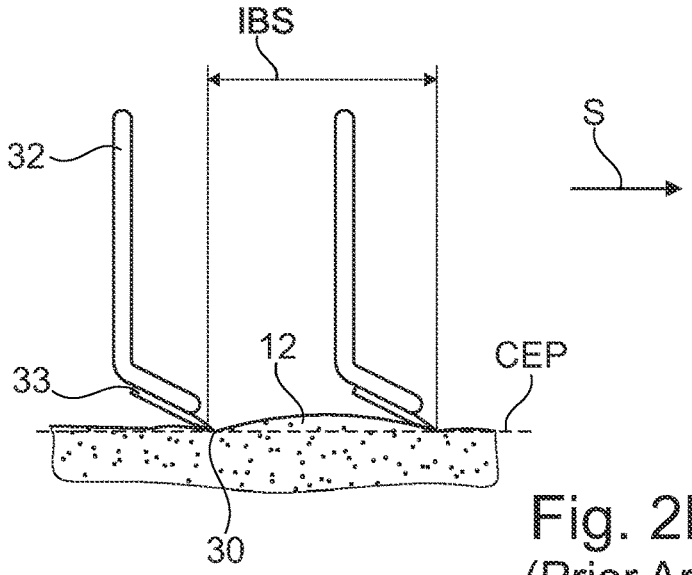
Fig. 2b (Prior Art)

FIGS. 2*a* and 2*b* are schematic side views of a portion of a prior art razor cartridge in use. In conventional razor cartridges with three or more blades, the inter-blade span is measured to be constant in a range of about 1.05 mm to 1.5 mm, and the razor blade is mounted on the top of the blade support. The cutting edge plane CEP is defined as the plane intersecting the first and second skin contact areas of, for example, cutting edges of the shaving head (in a two-dimensional cut-through, the cutting edge plane would be a line intersecting the cutting edges of the blades).

The phrase "top of the blade support" for the purposes of this specification means a side of a blade support of a razor cartridge that is closest (or faces towards) to a cutting edge plane CEP when the razor cartridge is in use, as illustrated in FIGS. 2*a* and 2*b*.

When a razor cartridge with such top-mounted cutting members is used, aggressive shaving may result in an increased degree of nicks and cuts and an increased sense of irritation, because the cutting edge plane CEP is exclusively supported by the cutting edges 30 of the blades on the blade support. This provides the skin with a relatively small surface to be supported on during shaving, and causes an increased degree of "bulging" 12 of the skin between the inter-blade gaps.

The phrase "bottom of the blade support" for the purposes of this specification means a side of a blade support of a razor cartridge that is further away from a cutting edge plane CEP than the top of the blade support when the razor cartridge is in use. When a razor cartridge with such bottom-mounted cutting members is used, aggressive shaving may result in a reduced degree of nicks and cuts and a reduced sense of irritation, because the cutting edge plane CEP is supported both by the cutting edges 30 of the blades on the blade support, and the distal portions 30*ax*, 30*bx* of the support members. This provides the skin with a larger support surface during shaving, and causes an increased degree of "bulging" 12 of the (skin) between the inter-blade gaps.

Figure 3:
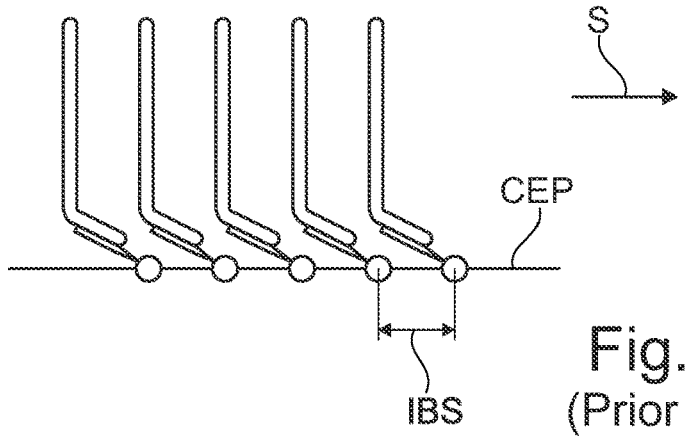
Fig. 3 (Prior Art)
FIG. 3 shows a schematic side view of a portion of a prior art razor cartridge in use.

FIG. 3 is a schematic side view of a portion of a prior art razor cartridge in use. To reduce the effect of skin bulging 12, the inter-blade span IBS can be reduced, as illustrated in FIG. 3. However, this results in a reduced gap for rinsing, and debris such as foam or hair can easily block a gap having a narrow inter-blade span. A greater blade density (number of blades in the same-sized cartridge) is also required when the IBS between all blades is reduced.

Figure 4:
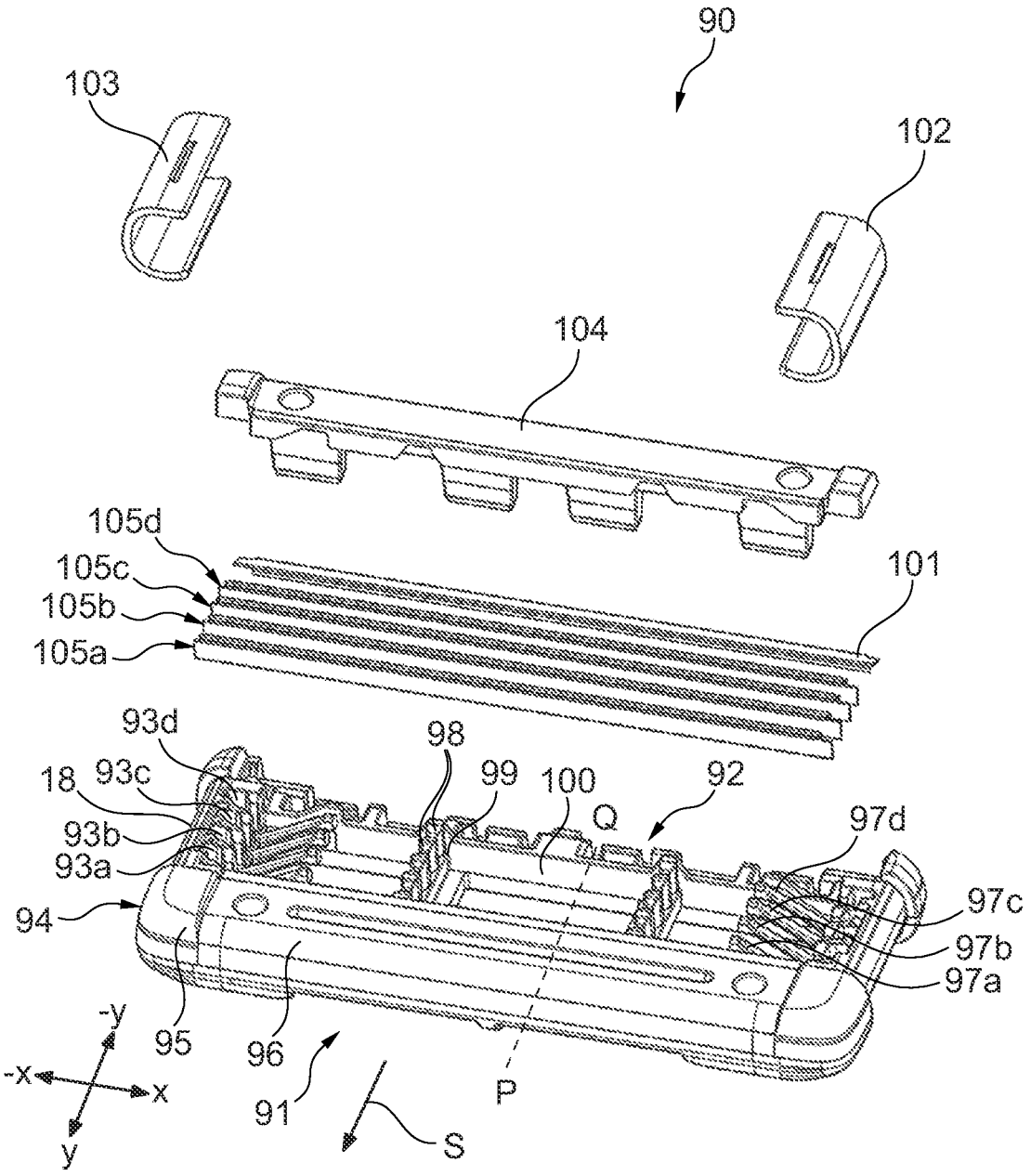
Fig. 4 (Prior Art)
FIG. 4 shows a perspective partial exploded view of a razor cartridge comprising a skin care element.

FIG. 4 illustrates an exploded perspective view of a conventional razor cartridge 90 comprising a skin care element 104. In this case, the skin care element 104 is a lubricating element provided on a rear cap at the trailing longitudinal side 92 of the razor cartridge 90. The cutting members 105*a-d* are conventional cutting members comprising blades mounted disposed on an outer surface of the respective blade supports that, in use, faces towards a shaving plane. The cutting members 105*a-d* do not have a variable inter-blade spacing. The remaining reference numerals referring to features of the conventional cartridge denoted in FIG. 4 are discussed in the "reference numeral section".

The conventional razor cartridge illustrated in FIG. 4 uses a skin care element 104 to lubricate the razor cartridge 90 when it is moved over the skin of a user in a shaving direction. The lubricating effect of the skin care element improves the glideness that the user experiences, but increases the bill of materials cost, reduces the packing density, and makes the blade wider in a direction transverse (y) to the longitudinal direction (x).

Accordingly, such razor cartridges 90 comprising skin care elements 104 can be further improved.

Figure 5:
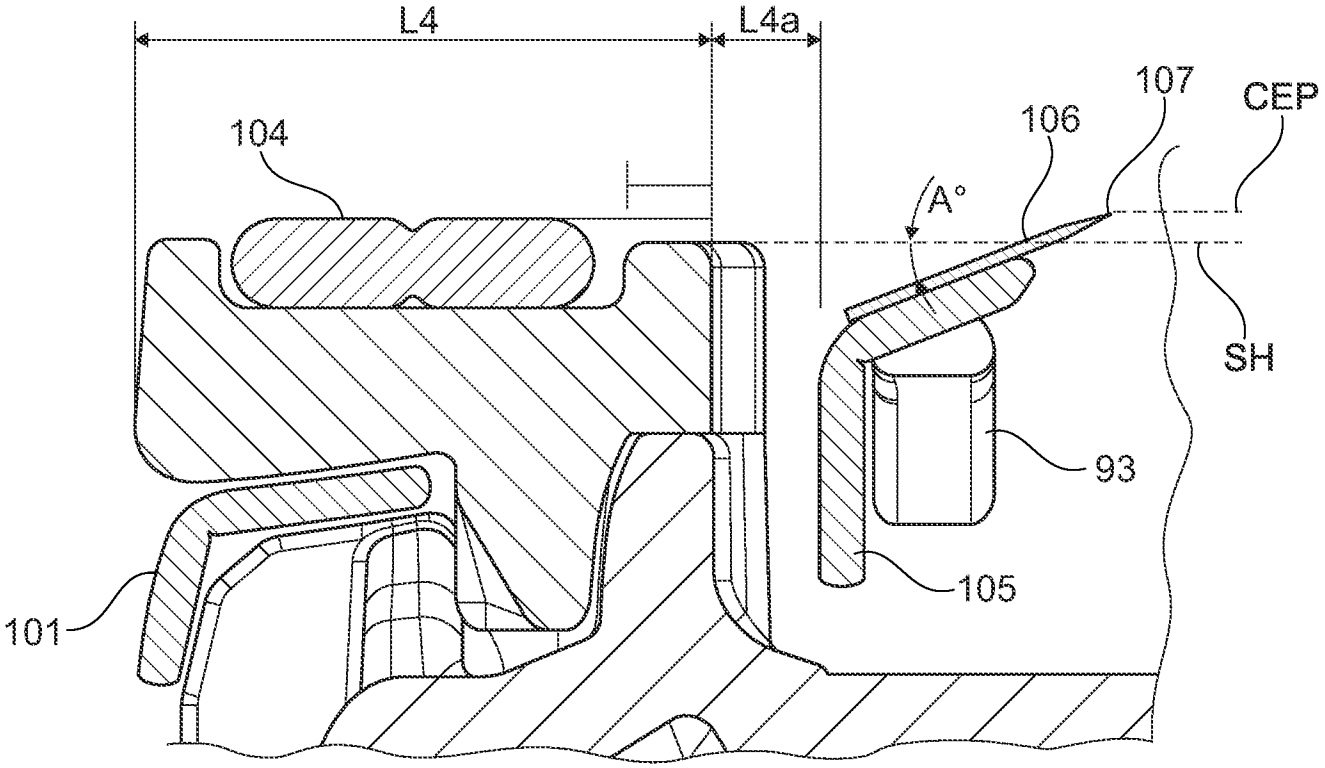
Fig. 5 (Prior Art)
FIG. 5 shows a schematic side view of the trailing longitudinal edge of the razor cartridge shown in FIG. 4 along axis P-Q.

FIG. 5 shows a schematic side view of the trailing longitudinal edge of the razor cartridge 90 comprising a skin care element 104 shown in FIG. 4 along axis P-Q.

As is known in conventional razors, the skin care element 104 may be provided as a longitudinal porous strip that can contain a substance that, upon contact with moisture, produces a lubricating layer. The distance L4 defines the width of the rear portion of the housing of razor 90 and must be wide enough to accommodate the skin care element 104.

Typically, the distance L4 defining the width of the trailing longitudinal portion of the housing is greater than 3.74 mm+−0.01 mm, for example. The skin care element 104 may be offset by an offset distance L4*a* 0.55 mm+−0.01 mm, for example.

Figure 6:
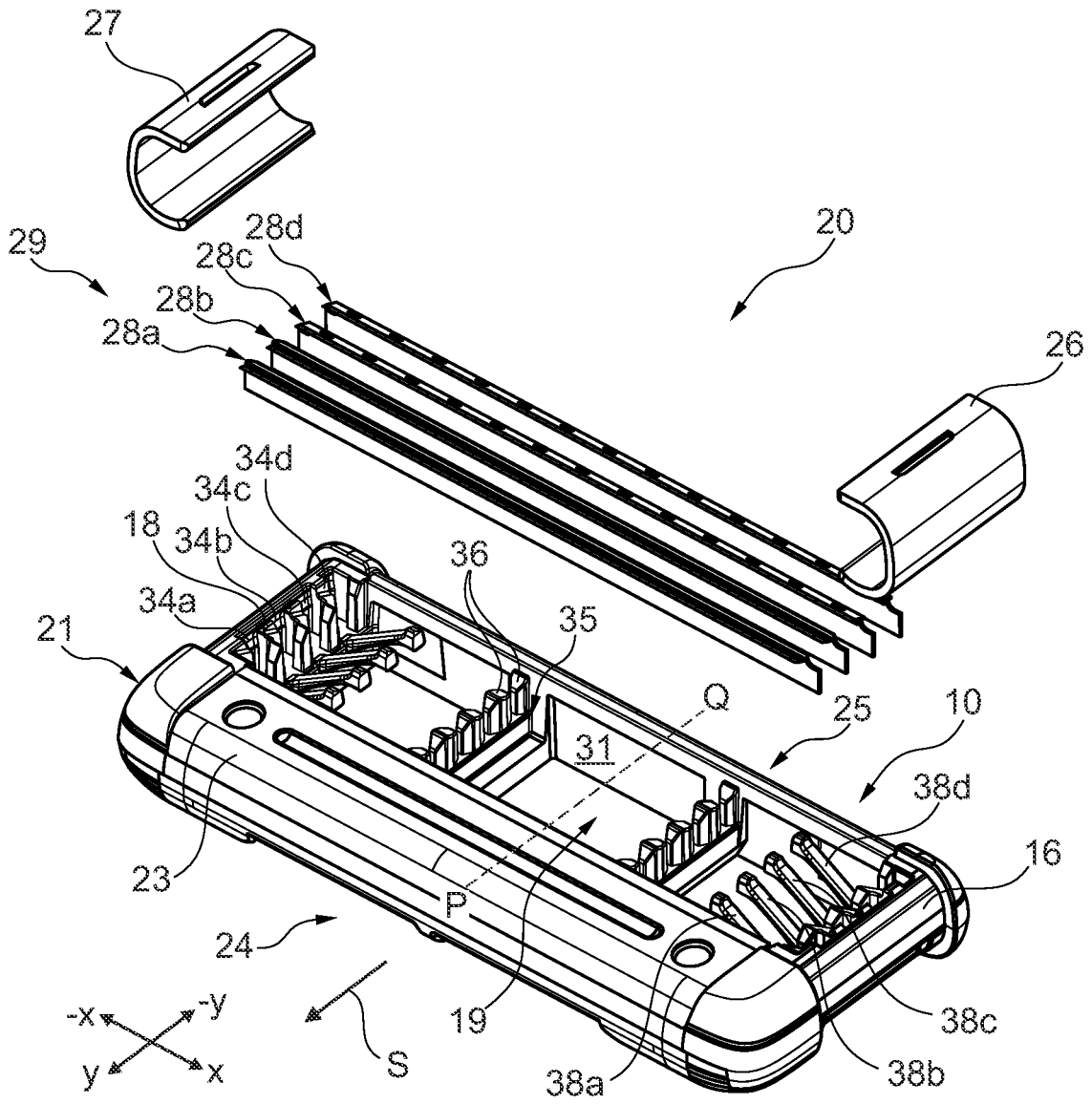
FIG. 6 shows a perspective partial exploded view of a razor cartridge according to an aspect.

FIG. 6 shows a perspective partial exploded view of a razor cartridge according to an example of the first aspect.

"Partial exploded view" means that some minor components of the razor cartridge 20 have been omitted from the exploded view to aid clarity of the drawing.

The shaving direction S is depicted in FIG. 4 using arrow S. The cutting edges 30*a-d* of the blades 33*a-d* define a CEP. In use, the razor cartridge 20 contacts the cutting edge plane CEP (not shown in FIG. 4), and is translated across the cutting edge plane CEP in the direction of arrow S.

According to a first aspect, there is provided a razor cartridge 20. The razor cartridge 20 comprises a housing 21 extending along a longitudinal axis x. The housing 21 comprises a leading longitudinal side 24 and a trailing longitudinal side 25, and a cutting member mounting portion 19 (recess) provided in between the leading longitudinal side 24 and the trailing longitudinal side 25. The razor cartridge 20 further comprises three or more substantially parallel cutting members 28*a-d* disposed in the cutting member mounting portion 19 in a shaving direction S of the razor cartridge 20.

At least one of the three or more cutting members 28*a-c* comprises a blade support 32.

The blade support 32 comprises a blade mounting portion 70 disposed on an inner surface of the respective blade support 32 that, in use, faces away from a shaving plane SH, and a blade 33 attached to the blade mounting portion 70. The cutting members 28*a-d* are disposed to define a plurality of inter-blade spans 40-42 between cutting edges 30*a-d* of the blades 33*a-d*. The trailing longitudinal side 25 of the housing 21 does not comprise a skin care element.

In other words, the portion of the material from which the housing 21 is made comprising the trailing longitudinal side 25 of the housing 21 is configured, in use of the razor cartridge 20, to directly contact the skin of a user of the razor cartridge 20. Conventionally, at the trailing longitudinal side 25 of the housing 21, a skin care element is provided in between the portion of housing material 21 and the skin of a user of the razor cartridge 20.

A housing 21 may be fabricated partially or completely of synthetic materials, such as plastic, resin, or elastomers. The housing 21 (frame 21) comprises a platform member connectable to a handle 2 of a shaving razor assembly 1 either integrally, or by a connection mechanism such as a pivotable bearing member 8 or by an interconnecting member (not shown). The omission of a skin care element enables the width of the trailing longitudinal side of the housing 21 to be significantly reduced.

Figure 7:
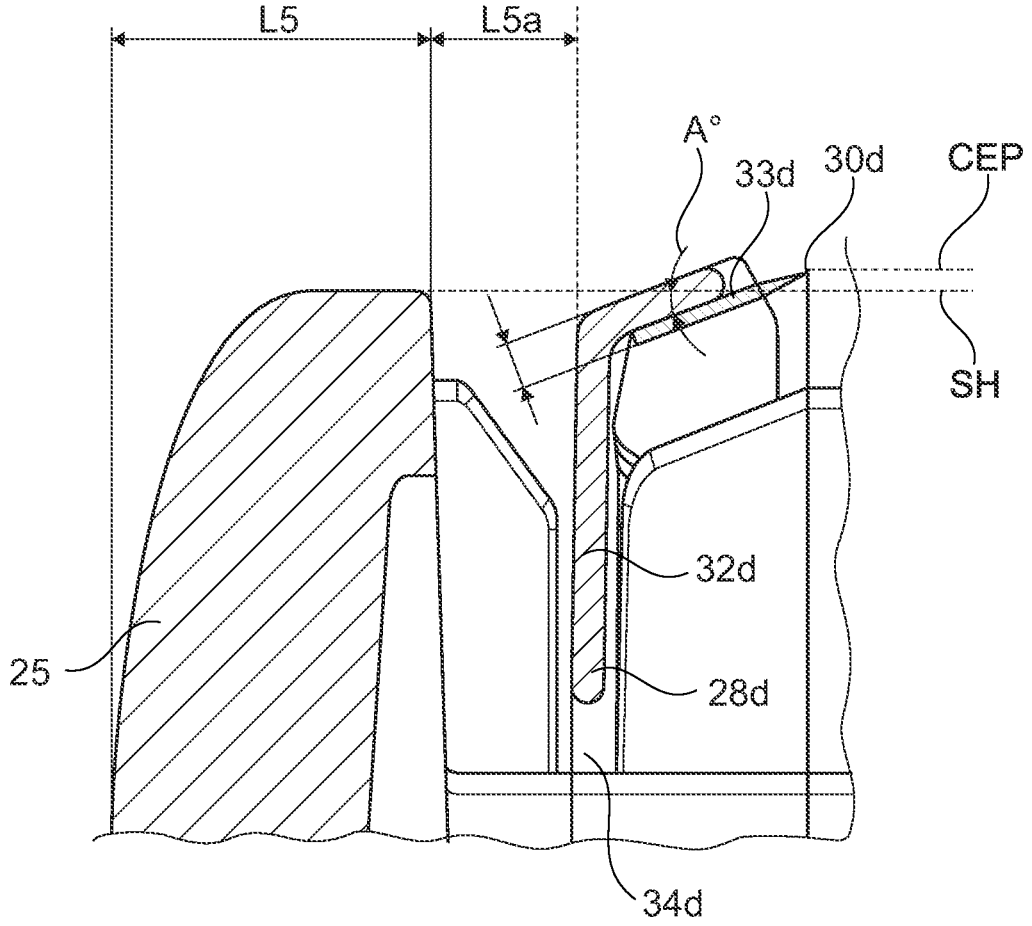
FIG. 7 shows a schematic side view of the trailing longitudinal edge of the razor cartridge according to an aspect shown in FIG. 6 along axis P-Q in FIG. 6.

Turning briefly to FIG. 7, this diagram shows a schematic side view of the trailing longitudinal edge of the razor cartridge according to an aspect shown in FIG. 6 along axis P-Q in FIG. 6, in which like elements are denoted with like reference numerals.

It may be seen that the width L5 of the trailing longitudinal portion 25 of the housing 21 is significantly reduced owing to the omission of the skin care element 104. In an example, the width L5 of the trailing longitudinal portion 25 of the housing is 1.51 mm+−0.01 mm. In an example, the span L5*a* between the trailing cutting member to the housing 21 is 0.72 mm+−0.01 mm. This is not enough space to provide a skin care element. Advantageously, however, the overall width of such a razor cartridge 20 is reduced, enabling a higher packing density of razor cartridges according to the first aspect. Furthermore, the razor cartridge 20 according to the first aspect may be more maneuverable in confined spaces owing to its reduced width. These benefits are achieved without detriment to glideness properties and nicking performance whilst shaving, because the provision of a blade mounting portion disposed on an inner surface of the respective blade support that, in use, faces away from a shaving plane, and a blade attached to the blade mounting portion improves gliding properties of the razor cut of 20 and reduces the occurrence of nicking and skin bulging during shaving.

In other words, the trailing longitudinal side 25 of the housing 21 does not comprise a cap member.

In embodiments, a guard member 23 is provided as a substantially longitudinal edge of the razor cartridge 20. In use, the guard member 23 is the first portion of the razor cartridge 20 to contact uncut hairs, and it is thus located at a leading longitudinal side 24 of the razor cartridge 20. The side of the razor cartridge 20 opposite to the leading longitudinal side of the razor cartridge 20 and opposite to the shaving direction is the trailing longitudinal side 25 of the razor cartridge 20. The trailing longitudinal side 25 is thus the final portion of the razor cartridge 20 to contact the shaving plane SH, in use.

In an example, the guard member 23 comprises an elastomeric member (not shown in FIG. 4). In an example, the elastomeric layer comprises one or more fins extending longitudinally in parallel to the guard member 23 and substantially perpendicularly to the shaving direction. One purpose of such an elastomeric layer is, for example, to tension the skin prior to cutting.

The razor cartridge 20 further comprises a group of cutting members 29 accommodated in a blade receiving section 31 of the housing 21. The group of cutting members 29 comprises a plurality of cutting members 28*a-d*. The group of cutting members 29 is disposed in the housing 21 longitudinally and parallel to the shaving direction S, such that in use, blades of the cutting members 28*a-d* contact a cutting edge plane CEP and cut hair present on the cutting edge plane CEP as the razor cartridge 20 is moved across the cutting edge plane CEP in the shaving direction S. A plane passing through the cutting edges 30*a-d* of the cutting members 28*a-d* is a cutting edge plane CEP.

The particular design of the group cutting members 29 will be discussed in detail subsequently. In an example, a razor cartridge is provided with three cutting members. In an example, a razor cartridge is provided with four cutting members. In an example, a razor cartridge is provided with five cutting members. In an example, a razor cartridge is provided with six cutting members. In an example, a razor cartridge is provided with seven or more cutting members.

The group of cutting members 29 defines a plurality of substantially parallel inter-blade spans. The number of inter-blade spans is one fewer than the number of cutting members.

The housing 21 further comprises first retainer 26 and second retainer 27 configured to hold the razor blades within razor cartridge 20. The housing 21 further comprises first 16 and second 18 side portions. When the razor cartridge 20 is in an assembled state, the first and second side portions 16, 18 are configured to fixedly confine the longitudinal ends of the guard member 23 and the group of cutting members 29. The first side retainer 26 and second retainer 27 may comprise, for example, plastic, an elastomer, or a metal material and furthermore may be of a different shape to that illustrated.

Although not illustrated, a pivotable bearing member may, in an example be provided on the side of the razor cartridge 20 configured to connect to a pivotable handle 2. Such a pivotable bearing member, in an example, comprises two or more shell bearings configured to connect to the pivotable bearing member 8 of the handle 2.

The cutting members comprised in the group of cutting members 29 are disposed in the razor cartridge such that two cutting edges 30 comprised, respectively, on the two foremost (nearest to the leading side of the razor cartridge) cutting members of the group of cutting members 29 define a leading inter-blade span that is closest to the leading longitudinal side 24 of the razor cartridge 20 and that is greater than a trailing inter-blade span defined between the two cutting edges that are closest to the trailing longitudinal side 25 of the razor cartridge. The inter-blade spans are illustrated further in FIG. 9 and discussed subsequently.

The each cutting member in the group of cutting members 29 comprises a longitudinal blade support 32. A longitudinal blade is mounted on the blade support 32. The cutting edge 30 of a cutting member 28*a-d* is oriented forward in the direction of shaving S. The blade support 32 of a cutting member 28*a-d* is an elongated, bent piece of rigid material. In an example, the blade support 32 is a metal such as austenitic stainless steel.

Each cutting member in the group of cutting members 29 is, in an example, resiliently mounted in a blade receiving section 31 of the razor cartridge 20. The blade receiving section 31 comprises a longitudinal space in the razor cartridge 20 that is sized to accommodate the group of cutting members 29. At least one cutting member of the group of cutting members 29, up to all cutting members in the group of cutting members 29 may be resiliently mounted in the blade receiving section 31. In the illustrated example of FIG. 6, the transverse inner sides of housing 21 comprise a plurality of holding slots 34. Each holding slot 34 on the transverse inner sides is configured to accept and retain one side of a blade support 32 of a cutting member of the group of cutting members 29 so that the cutting members of the group of cutting members 29 are held in the blade receiving section 31 with a substantially parallel inter-blade span. Therefore, as many holding slots 34 are provided in each transverse inner side of housing 21 as there are blade support members.

Between the blade receiving section 31 and the handle 2 (in a part adjacent to a handle connection, for example) there are, in examples, provided one or more cross members 35 that are integrally formed with the housing 21. The cross members 35 may comprise a plurality of blade support guides 36 provided as a plurality of protuberances aligned with the holding slot 34 on the transverse inner sides of the housing 21. The blade support guides 36 function to regulate the parallel inter-blade span in a longitudinal direction as well as to ensure stability of the blades during shaving.

In embodiments, a razor cartridge 20 has a variable inter-blade span IBS. Therefore, in one variant, the spacing of the blade supports 32 is progressively decreased between the leading longitudinal side 24 and the trailing longitudinal side 25 of the razor 20 to generate the variable inter-blade span IBS.

In embodiments, the inter-blade span is constant in a range of 1.6 to 2.2 mm, specifically 1.8 mm.

An alternative way to achieve this arrangement is to progressively decrease the spacing between the holding slots 34 provided on the transverse inner sides in a transverse direction (y to −y) of the razor cartridge. The positioning and/or width of the blade support guides 36 is adjusted commensurately such that the group of inter blade spaces IBS between cutting edges 30 of the cutting members 28*a-d* is parallel.

The razor cartridge 20 of FIG. 6 as comprises four resilient fingers 38*a*, 38*b*, 38*c*, 38*d* under the first retainer 26. The razor cartridge 20 comprises four resilient fingers under the second retainer 27 that are in transverse corresponding alignment with the four resilient fingers 38*a*, 38*b*, 38*c*, 38*d* under the first retainer 26.

In total, the eight resilient fingers each exert a bias force against respective cutting members of the group of cutting members 29 in the direction of the cutting edge plane CEP such that the cutting members of the group of cutting members 29 are in a rest position, when assembled. In the rest position, the cutting edges 30 of the blades 33, at each lateral end of the blades 33 near the first 26 and second 27 retainers, bear against corresponding stop portions, for example. In an example, the stop portions may be the first 26 and second 27 retainer.

Accordingly, the rest position of the cutting members 28*a-d* is well defined, enabling a high shaving precision. The illustrated biasing arrangement has many variations. For example, a further plurality of resilient fingers may be provided on one or more of the cross members 35. In a simplified razor cartridge design (such as for low cost, disposable razors), the resilient fingers may be omitted.

A skilled person will appreciate that the number of resilient fingers 38 to be provided is related to the number of cutting members 28*a-d* in the group of cutting members 29, and that fewer or more than eight resilient fingers 38 can be provided.

Figure 8:
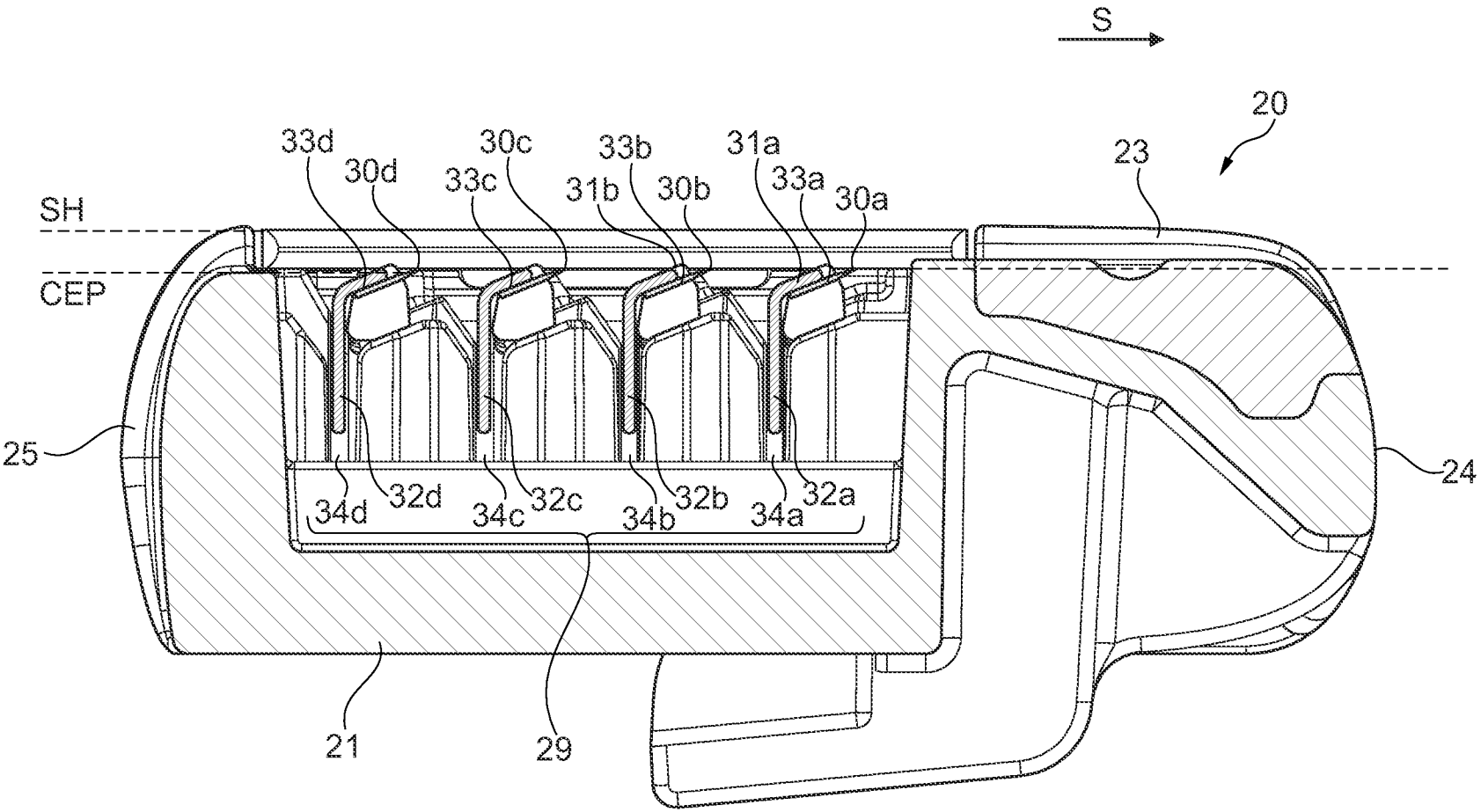
FIG. 8 shows a schematic side view of the razor cartridge according to an aspect along axis P-Q in FIG. 6.

FIG. 8 is a schematic cutaway side view of a razor cartridge taken from the embodiment of FIG. 4 along transverse axis P-Q illustrated by the dotted line in FIG. 4. Where possible, like elements are denoted with like reference numerals.

FIG. 8 illustrates a side view of the holding slots 34 provided in the inner side of the housing 21 for holding the group of cutting members 29. The plurality of blade support guides 36 and the plurality of resilient fingers 38 shown in FIG. 4 is not shown in the projection of FIG. 5 to aid clarity.

FIG. 8 illustrates the progressively decreasing span in the longitudinal direction between the succession of holding slots 34 for holding the group of cutting members 29 provided in the first 16 and second 18 side portions, in the direction from the leading longitudinal side 24 to the trailing longitudinal side 25.

The provision of a succession of holding slots 34 in the first 26 and second 27 retainers to support the cutting members of the group of cutting members 29 is not essential. The group of cutting members 29 could also be supported using a plurality of blade support guides 36 (protuberances) positioned on one or more cross members 35, for example, where the plurality of blade support guides 36 provide a progressively decreasing inter-blade span in the longitudinal direction from the leading longitudinal side 24 to the trailing longitudinal side 25 of the razor cartridge 20.

In an example, a plurality of blade support guides 36 and a succession of holding slots 34 may be used in combination to provide progressively decreasing span in the longitudinal direction.

Figure 9:
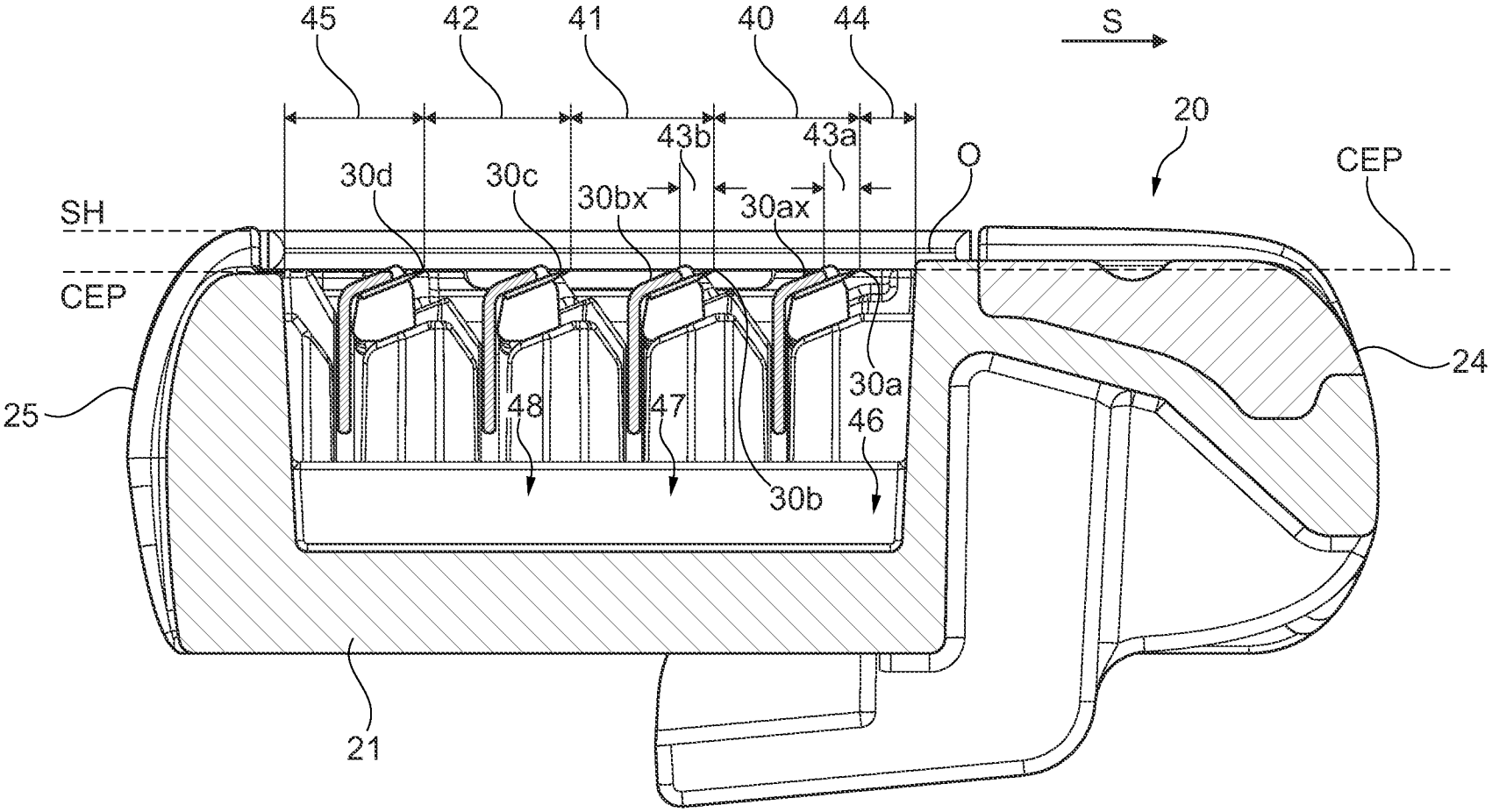
FIG. 9 shows a duplicate of the schematic cutaway side view of the razor cartridge according to an aspect that has been differently annotated to illustrate the inter-blade spacing.

FIG. 9 is a duplicate of the schematic cutaway side view of the razor cartridge 20 shown in FIG. 8 that has been annotated to denote inter-blade spacing. The longitudinal line on the internal leading longitudinal wall of the blade receiving section 31 that is closest to a cutting edge plane CEP in use serves as an origin O for the purposes of the present definition.

A leading blade 33*a* to housing 21 span 44 is the transverse span (substantially aligned with the shaving direction S) that is perpendicular to the longitudinal orientation of the blades of the group of cutting members 29 that spans the space between the internal leading longitudinal wall of the cutting member mounting portion 19 that is closest to a cutting edge plane CEP in use (the origin) and the cutting edge 30*a* of the leading blade 33*a* of the group of cutting members 29.

A leading inter-blade span 40 that is the closest inter-blade span to the leading longitudinal side 24 of the razor cartridge is a transverse span (substantially aligned with the shaving direction S in use) that is substantially perpendicular to the longitudinal orientation of the blades of the group of cutting members 29. The leading inter-blade span 40 begins at a point on cutting edge 30*a* and ends on a corresponding point on the cutting edge 30*b* of the first intermediate blade 33*b*.

A first intermediate inter-blade span 41 is a transverse span (substantially aligned with the shaving direction S in use) that is substantially perpendicular to the longitudinal orientation of the blades of the group of cutting members 29. The first intermediate inter-blade span 41 begins at a point on cutting edge 30*b* and ends on a corresponding point on the cutting edge 30*c* of the second intermediate blade 33*c*.

A trailing inter-blade span 42 is a transverse span (substantially aligned with the shaving direction S in use) that is perpendicular to the longitudinal orientation of the blades of the group of cutting members 29. The trailing inter-blade span 42 begins a point on cutting edge 30*c* and ends on a corresponding point on the cutting edge 30*d* of the blade 33*d* that is closest to the trailing longitudinal side 25 of the razor cartridge 20.

A trailing blade to housing span 45 that is a transverse span (substantially aligned with the shaving direction S in use) that is perpendicular to the longitudinal orientation of the blades of the group of cutting members 9. The trailing blade to housing span 45 begins at a point on the cutting edge 30*d* and ends at a corresponding point on the internal trailing longitudinal wall of housing 21.

Thus, the total span of the blade receiving section 31 corresponds to the sum of spans 44, 40, 41, 42, and 45. In practice, the total span of the blade receiving section may be in the range of 7 to 15 mm.

As will subsequently be discussed, each blade mounting portion 70 provided on an inner face 64 of the blade support 32 that, in use, faces away from cutting edge plane CEP. The cutting edge 30 extends forward from the front of the blade support 32. However, the blade support 32 has a non-negligible thickness T2. For example, the blade support 32 has a thickness T2 in the range 0.12 mm-0.21 mm, and more specifically in the range 0.155 mm-0.185, and most specifically 0.17 mm.

Consequently, a non-negligible span defined as the transverse span (substantially aligned with the shaving direction S in use) that is perpendicular to the longitudinal orientation exists between each cutting edge 30 and the blade-mounting end of each blade support 32 of each cutting member of the group of cutting members 29. This may be referred to as a cutting edge to blade span 43 of a respective cutting member. The edge support span may be derived using trigonometry based on the thickness of the blade support 32 and the tilt angle relative to the shaving plane of the blade receiving section 31 of the blade support 32.

In an example, each blade support 32 of the group of cutting members 29 is identical and has the same thickness T2 and the same tilt angle A. In this case, the cutting edge to blade span 43*a*, 43*b*, 43*c*, and 43*d* is identical.

In an example, one or more of the cutting edge to blade spans 43*a*, 43*b*, 43*c*, and 43*d* are in the range 0.3 mm to 0.6 mm, and specifically 0.5 mm.

In an example, at least one blade support 32 of the group of cutting members 29 has a different thickness and/or tilt angle to the remainder of the blade supports 32. In this case, at least one a cutting edge to blade span 43*a* will differ from the remainder. An effect is that individual cutting edge to blade span 43*a*-43*d* may be individually tuned to provide further fine control over skin bulge effects. For example, the cutting edge to blade span 43*a*-43*d* may be designed to progressively increase or decrease.

A leading blade to housing span 44 is a transverse span (substantially aligned with the shaving direction S in use) that is perpendicular to the longitudinal orientation of the blades of the group of cutting members 29. The leading blade to housing span begins at a point on the internal leading longitudinal wall that is, in an example, closest to the cutting edge plane CEP. The leading blade to housing span ends at a corresponding point on the cutting edge 30*a* of the blade 33*a* of the leading cutting member 28*a* that is in an example, closest to the cutting edge plane CEP.

In an example, the leading housing to blade span 44 is 0.5 mm to 0.9 mm, and specifically 0.7 mm A trailing blade to housing span 45 is a transverse span (substantially aligned with the shaving direction S in use) that is perpendicular to the longitudinal orientation of the blades of the group of cutting members 29. The trailing blade to housing span 45 begins at a point on the cutting edge 30*d* of the blade 33*d* of the trailing cutting member 28*d*. The trailing blade to housing span 45 ends at a corresponding point on the internal trailing longitudinal wall that is, in an example, closest to the cutting edge plane CEP.

In an example, the trailing housing to blade span 45 is 1.6 mm to 2.0 mm, and specifically 1.8 mm. In an example, the leading blade to housing span 44 is greater than the trailing blade to housing span 45. In an example, the leading blade to housing span 44 is smaller than the trailing blade to housing span 45. In an example, the leading blade to housing span 44 is substantially equal to the trailing blade to housing span 45. In an example, the leading blade to housing span 44 is greater than the leading inter-blade span 40. In an example, the leading blade to housing span 44 is substantially equal to the leading inter-blade span 40. In an example, the leading blade to housing span 44 is smaller than the leading inter-blade span 40. In an example, the trailing blade to housing span 45 is greater than the trailing inter-blade span 42. In an example, the trailing blade to housing span 45 is substantially equal to the trailing inter-blade span 42. In an example, the trailing blade to housing span 45 is smaller than the trailing inter-blade span 42. In an example, the first intermediate inter-blade span 41 and the second intermediate inter-blade span 42 are each substantially equal to the leading inter-blade span 40. In an example, the first intermediate inter-blade span 41 and the second intermediate inter-blade span are each substantially equal to the trailing inter-blade span 42. In an example, the first intermediate inter-blade span 41 is less than the leading inter-blade span 40 and greater than the second intermediate inter-blade span.

In an example, the second intermediate inter-blade span is equal to the trailing inter-blade span 42. In an example, a leading inter-blade span that is closest to the leading longitudinal side of the razor cartridge is greater than a trailing inter-blade span that is closest to the trailing longitudinal side of the razor cartridge.

FIG. 9 also illustrates a first debris run-off portion 46, a second debris run-off portion 47, and a third debris run-off portion 48. The width of the debris run-off portions is defined by the relative spacing of the cutting members of the group of cutting members 29.

As illustrated, the first debris run-off portion 46 is wider than the second debris run-off portion 47, which in turn is wider than the third debris run-off portion 48. An effect of this is that, in use, a greater amount of hair clippings and foam can be removed via the first (relatively wider) debris run-off portion 46. This reduces the risk of blockage of the debris run-off portions, particularly when the razor cartridge is used by infrequent shaver users, because the most troublesome debris can escape via the first (relatively wider) debris run-off portion 46.

The leading blade to housing span 44 may be larger than, equal to, or smaller than the leading inter-blade span 40. The trailing blade to housing span 45 may be larger than, equal to, or smaller than the trailing inter-blade span 42.

The leading inter-blade span 40 is greater than the trailing inter-blade span 42.

In an example, the first intermediate inter-blade span is equal to, or less than, the leading inter-blade span. In an example, the first intermediate inter-blade span is equal to, or greater than, the trailing inter-blade span.

Although a razor cartridge with four blades 33*a-d* has been illustrated, the present specification also includes a razor cartridge comprising three blades, or greater than four blades. For example, five substantially parallel cutting members 28*a-d* may be disposed in a shaving direction of the razor cartridge 20, wherein a second intermediate inter-blade span is defined adjacent to the trailing inter-blade span 42. In an example, the first intermediate inter-blade span 41 and the second intermediate inter-blade span are each substantially equal to the leading inter-blade span. In an example, the first intermediate inter-blade span 41 and the second intermediate inter-blade span are each substantially equal to the trailing inter-blade span 42. In an example, the first intermediate inter-blade span is less than the leading inter-blade span 40 and greater than the second intermediate inter-blade span. In an example, the second intermediate inter-blade span is equal to the trailing inter-blade span 42. In an example, consecutive inter-blade spans of the razor cartridge successively decrease between the leading longitudinal side 24 and the trailing longitudinal side 25 of the razor cartridge in the shaving direction.

In an example, one or more of the blade supports 32*a-d* comprises front edges 30*ax*, 30*bx* configured, in use, to contact the cutting edge plane CEP in addition to the cutting edges 30*a-d* of the blades, thereby reducing the pressure at each cutting edge contact point with the cutting edge plane CEP. The pressure at the cutting edge contact points may therefore be reduced, and the drag force when shaving is reduced, and more evenly distributed, thus removing the need for a skincare element at the trailing longitudinal side 25 of the razor cartridge 20. In examples, the blade supports 32 comprise distal rounded or chamfered edges 31*ax*, 31*bx* to improve the glideness properties of the razor cartridge.

Figure 10:
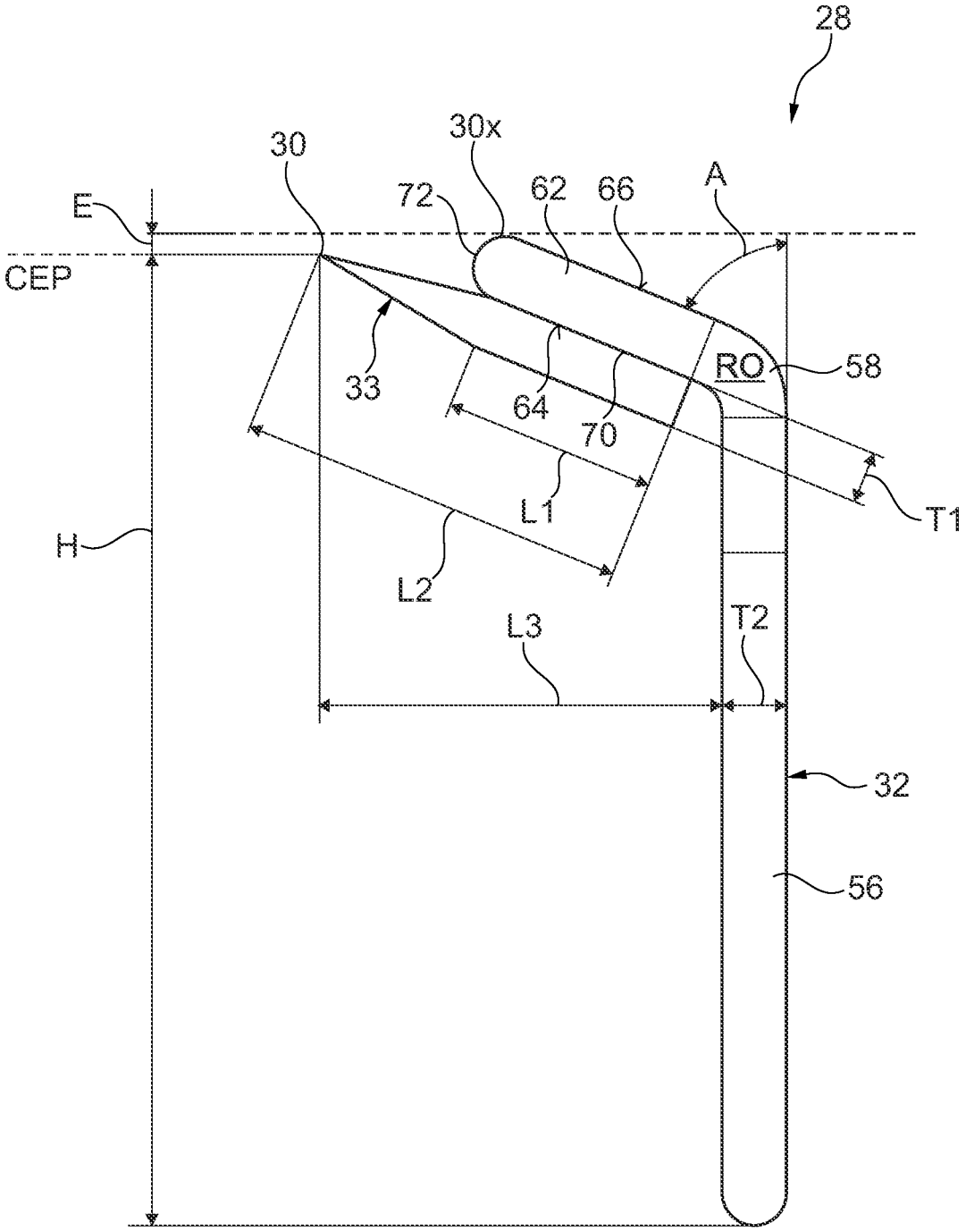
FIG. 10 is a schematic side view of a cutting member comprising a blade mounting portion disposed on an inner surface of the respective blade support that, in use, faces away from a shaving plane.

FIG. 10 is a schematic side view of a cutting member comprising a blade mounting portion disposed on an inner surface of the respective blade support that, in use, faces away from a shaving plane.

In embodiments, a blade mounting portion of the blade support 32 is disposed on an inner surface of the respective blade support that, in use, faces away from a shaving plane or surface SH, and a blade attached to the inner face 64 of the blade support as shown in FIG. 10.

According to the present approach, the blade 33 is mounted on an inner surface of the respective blade support and projects from underneath the inner surface defining a cutting edge to blade span 43 between a cutting edge 30 of the blade and the end of the blade support 32 towards the shaving plane SH. In use, as the cutting member 28 contacts the cutting edge plane CEP, both the cutting edge 30 of the blade 33 and the end of the blade support 32 contact the shaving simultaneously, leading to a reduction in the force exerted on the cutting edge plane CEP exerted by a single cutting edge, for example.

In other words, the position of a blade 33 on a blade support 32 when a cutting member 28*a-d* is mounted in the razor cartridge is defined by the fact that an imaginary tangent provided from the surface of the blade 33 that is directed away from the shaving plane SH does not pass through any point of the blade support 32 that the blade 33 is mounted on.

A further definition of the position of a blade 33 on the blade support is that when a cutting member 28*a-d* is mounted in the razor cartridge, an imaginary tangent provided from the portion of the blade 33 in contact with the blade mounting portion 70 that is directed towards the shaving plane SH in use passes through the blade support 32 that the blade 33 is mounted on.

A longitudinal blade support member (not illustrated) comprises a substantially elongated flat lower portion, a substantially elongated flat top side and a radius bend portion. The radius bend portion may have an inner radius of curvature that is more than 0.1 mm. The radius bend portion may have an inner radius of curvature that is less than 0.9 mm. A minimum recommended inner radius of curvature of sheet metal should be at least the same as its thickness. A safety factor of the thickness of the blade support 32 may be applied. By multiplying the safety factor with the thickness of T2 (around 0.17 mm), the radius of curvature RO may be approximately 0.25 mm, more specifically between 0.16 mm and 0.40 mm, and most specifically between 0.25 mm or 0.28 mm.

The blade support 32 may be made from a flat sheet metal part which is bent before welding of the blade 33 on the inner surface 64 of the blade support 32. The cutting member 28 thus comprises a blade 33 (razor blade).

The blade 33 has, in its flat portion, a thickness T1 about 0.1 mm (for example, between 0.04 and 0.11 mm) The total length L2 of the blade 33 between the cutting edge 30 of the blade 33 and the opposite back edge of the blade 33 is about 1 mm (for example, between 0.8 mm and 1.3 mm) The portion of the blade 33 that is in contact with the inner surface 66 of a blade support that, in use, faces away from a shaving plane SH has a length L1 that is about 0.49 mm+/−0.1 mm long. In this way, a good retention of the blade on the underside of the blade support 32 (the inner surface of the blade support 32) is ensured.

In an example, the height H of the cutting member 28 is between 2.53 mm and 2.63 mm, more specifically 2.58 mm. In an example, the front end 72 of the blade support is rounded or chamfered to improve glideness properties of the cutting member. In an example, the blade 33 may be positioned on the inner surface 64 of the blade support 32 to adjust the exposure E of the cutting edge 30 positively or negatively compared to the cutting edge plane CEP. The exposure is a measure of how prominently the cutting edge 30 of a blade protrudes above or sinks below the end 72 of its blade support.

In an example, a local exposure is designated as the vertical distance between a cutting edge and a support plane, wherein the support plane is defined by a tangential line intersecting the tips of the blade supports. The blade 33 may be positioned to have an exposure relative to the support edge plane in the range −80 um to +80 um, more specifically an exposure of about −75 um, −65 um, −60 um, −55 um, −50 um, −45 um, −40 um, −35 um, −30 um, −25 um, −20 um, −15 um, −10 um, −5 um, 0 um, 5 um, 10 um, 15 um, 20 um, 25 um, 30 um, 35 um, 40 um, 45 um, 50 um, 55 um, 60 um, 65 um, 70 um, or 75 um.

The length L3 of the cutting member 28, between the cutting edge 30 and the outer face of the lower portion of the blade support 32 is about 1.0 mm (for example, between 0.9 mm and 1.6 mm).

The blade 33 is fixed on the inner surface 64 of the blade support by any known means, such as by laser spot welding. In embodiments, the blade 33 is fixed on the inner surface 64 of the blade support by a plurality of spot welds (for example, between ten and sixteen spot welds) distributed along the longitudinal dimension of the blade support 32. Each of the spot welds may be performed on the inner face 64 of the blade support 32. Alternatively, each of the spot welds may be carried out on the outer surface 66 of the blade support 32, or a mixture of the two.

The first intermediate inter-blade span 41 is smaller than the leading inter blade span 40 but greater than trailing inter-blade span 42, however this is not an essential feature. For example, the first intermediate inter-blade span 41 may be equal to either of the trailing inter-blade span 42 or the leading inter blade span 40.

Specific measurements of the separation distance ranges inter-blade spans will now be discussed. A skilled person will appreciate that many choices and combinations of inter-blade spans may be made that satisfy the above-discussed features of the razor cartridge 20, and that the following discussion is not limited to the disclosed values.

In an example, the leading inter blade span 40 is within a range of 1.6 mm to 2.2 mm, 1.70 mm to 2 mm, or 1.75 mm to 1.95 mm.

When three cutting members 28*a-c* are present, the leading inter blade spans defined above may still apply, in combination with a trailing inter-blade span 42 in a range of 1.6 mm to 2.2 mm, 1.70 mm to 2.00 mm, or within 1.75 mm to 1.95 mm.

When four cutting members 28*a-d* are present, the trailing inter-blade span 42 is in a range of 1.6 mm to 2.2 mm, 1.70 mm to 2.00 mm, or within 1.75 mm to 1.95 mm.

In an example, the leading inter blade span 40 is within a range of 1.7 mm to 2.2 mm, 1.8 mm to 2.0 mm, or is 1.85 mm.

In an example, the first intermediate inter blade span 41 is within a range of 1.55 mm to 1.95 mm, 1.60 mm to 1.80 mm, or is 1.70 mm.

In an example, the trailing inter-blade span 42 is within a range of 1.4 mm to 1.8 mm, specifically 1.50 mm to 1.65 mm, or is 1.55 mm.

In an example, the leading blade to housing span 44 is within a range of 0.4-1.0 mm, 0.5 mm to 0.8 mm, or is 0.7 mm.

In an example, the trailing blade to housing span 45 is within a range of 1.7 mm to 2.2 mm, 1.8 mm to 2.0 mm, or is 1.85 mm.

However, any possibly combination of inter-blade spans is possible, provided a leading inter-blade span that is closest to the leading longitudinal side 24 of the razor cartridge is greater than a trailing inter-blade span that is closest to the trailing longitudinal side 25 of the razor cartridge.

The ranges discussed above are generally increased as compared to conventional razor cartridges. The rinsability of a cartridge as discussed herein is generally improved, because more space is available between the cutting members 28*a-d* for debris to flow off closer to the leading edge of the razor cartridge 20. The size of skin bulges is also reduced, resulting in an improved shaving performance.

According to an embodiment in which the leading inter blade span 40 is larger compared to the first intermediate inter blade span 41 or the trailing inter-blade span 42, the first two blades that cut the highest amount of hair are far enough apart to ensure that the debris can be removed easily. The remainder of the blades may have a narrower IBS to reduce the risk of nicks and cuts.

Therefore, a safer shaving experience is provided with a reduced number of nicks and irritation. Providing the blade support "on top" of the blade provides an additional skin-contacting element (as well as the cutting edges 30 of the blades) which supports the skin during shaving. A skin care element is omitted from the trailing longitudinal side 25 of the razor cartridge 20 according to aspects.

According to a second aspect, there is provided a razor cartridge 20. The razor cartridge comprises a housing 21 extending along a longitudinal axis x. The housing 21 comprises a leading longitudinal side 24, a trailing longitudinal side 25, and a cutting member mounting portion 19 provided in between the leading longitudinal side and the trailing longitudinal side. The razor cartridge 20 according to the second aspect further comprises three or more substantially parallel cutting members 28*a-d* disposed in the cutting member mounting portion 19 in a shaving direction S of the razor cartridge 20. The at least one of the cutting members comprises a blade support 32*a-d*, wherein the blade support comprises a blade mounting portion 70 disposed on an inner surface of the respective blade support that, in use, faces away from a shaving plane SH, and a blade 33*a-d* attached to the blade mounting portion. The cutting members 28*a-d* are disposed to define a plurality of inter-blade spans 40-42 between cutting edges of the blades. A span defined between the rearmost portion of the substantially parallel cutting member that is closest to the trailing longitudinal side and the rearmost portion of the trailing longitudinal side of the housing is less than 2.35 mm.

An effect of the razor cartridge 20 according to the second aspect is that the trailing longitudinal side of the housing 21 is not wide enough to accommodate a skin care element. However, skin care element is not required because the provision of a plurality of inter-blade spans 40-42 has advantages as discussed previously of improving gladness and mitigating cuts when shaving.

As a skilled person will appreciate, all embodiments, variations, and subject-matter discussed in respect of the razor blade 20 according to the first aspect above may also be applied and combined with the subject-matter of the razor blade 20 according to according to the second aspect.

In embodiments of the second aspect, the span L5+L5*a* defined between the rearmost portion of the substantially parallel cutting member that is closest to the trailing longitudinal side and the rearmost portion of the trailing longitudinal side of the housing is less than 2.35 mm, less than 2.25 mm, less than 2.15 mm, less than 2.05 mm, less than 1.95 mm, less than 1.85 mm, or less than 1.75 mm but greater than 1 mm. The listed measurements are to a tolerance of +−0.01 mm.

Figure 11:
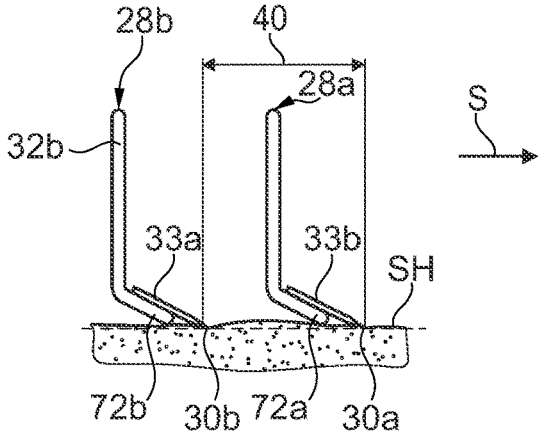
FIG. 11 illustrates a side view of a blade arrangement illustrating the reduction in skin bulging when enabling the blade support member to contact the skin during shaving.

FIG. 11 illustrates a side view of a blade arrangement illustrating the reduction in skin bulging when enabling the blade support member to contact the skin during shaving.

Figure 12:
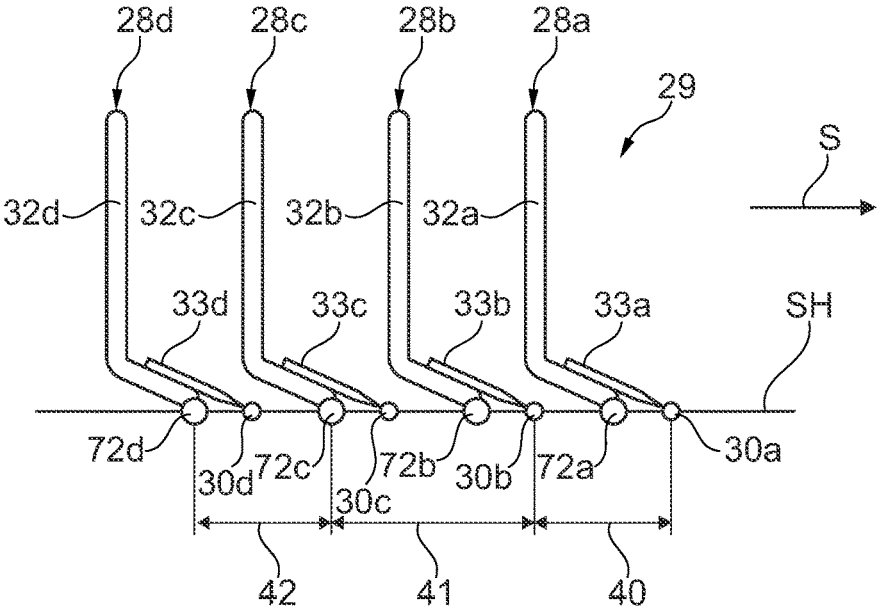
FIG. 12 illustrates a further side view of a blade arrangement illustrating the benefit of enabling the blade support member to contact the skin.

FIG. 12 illustrates a further side view of a blade arrangement illustrating the benefit of enabling the blade support member to contact the skin. The presence of rounded front edges of the blade support 72*a-d* reduces the space between the cutting edges 30*a-d* and their support members, thus reducing bulging.

Of course, it is not essential that all cutting members 28*a-d* are provided with blades mounted below the support 32*a-d*, i.e. blades mounted on a support surface that in use faces away from the shaving plane. In embodiments, one cutting member 28*a* is provided with the blades mounted below the support 32*a*, and the remaining cutting members 28*b-d* are provided with the blades mounted above their respective supports 28*b-d*.

In embodiments, at least one cutting member 28 is provided as a "bent blade". Accordingly, at least one of the three or more cutting members is an integrally formed razor blade having a cutting edge at its distal end, a base portion extending along a base portion plane, and a curvilinear portion intermediate the cutting edge portion and the base portion.

Figure 13:
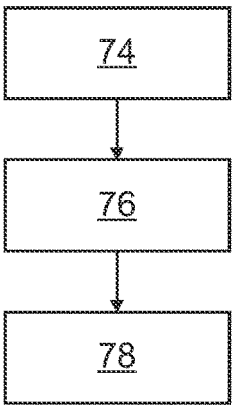
FIG. 13 illustrates a method of manufacturing a razor cartridge according to an aspect.

FIG. 13 illustrates a method of manufacturing a razor cartridge according to a third aspect. The method comprises:

obtaining 74 a housing extending along a longitudinal axis, wherein the housing comprises a leading longitudinal side, a trailing longitudinal side, and a cutting member mounting portion provided in between the leading longitudinal side and the trailing longitudinal side;

obtaining 76 three or more substantially parallel cutting members; and assembling 78 the housing and the three or more substantially parallel cutting members in the cutting member mounting portion of the housing between the leading longitudinal side and the trailing longitudinal side of the razor cartridge in a shaving direction of the razor cartridge;

wherein at least one of the cutting members comprises a blade support comprising a blade mounting portion disposed on an inner surface of the respective blade support that, in use, faces away from a shaving plane, and a blade attached to the blade mounting portion, wherein the cutting members are disposed to define a plurality of inter-blade spans between cutting edges of the blades; and wherein the housing does not comprise a skin care element, or wherein a span defined between the rearmost portion of the trailing longitudinal side of the housing and the rearmost portion of the substantially parallel cutting member that is closest to the trailing longitudinal side is less than 2.35 mm.

FIG. 1 illustrates a shaving razor assembly 1 according to a fourth aspect. The shaving razor assembly 1 comprises a razor handle 2 and a razor cartridge 20 according to the first aspect or one of its embodiments, wherein the razor cartridge is either releasably attached to the razor handle via a pivotable 8 or non-pivotable connection, integrally formed with the razor handle via a non-pivotable connection, or integrally formed with the razor handle via a pivotable connection.

According to a fifth aspect, there is provided a kit of parts comprising a razor handle 2 and a razor cartridge holder comprising a plurality of razor cartridges razor cartridge 20 according to the first aspect or its embodiments.

In the preceding specification, a razor blade comprising at least three cutting members 28*a-c* according to the aspect may have fourth and fifth blades, according to specific embodiments. The leading inter-blade span, the trailing inter-blade blade span, the first intermediate blade span, and where relevant the second inter-blade span are defined between the cutting edges 30 of the respective three, four, or five blades. For example, in the case of three cutting members 28*a-c*, a first intermediate blade span, and second inter-blade span and not present. In an embodiment with four cutting members 28*a-d*, a second intermediate inter-blade span it not present. In an embodiment with five blades, the leading inter-blade span, first and second intermediate inter-blade spans, and a trailing inter-blade span are present.

In the preceding specification, numerous specific details are set forth in order to provide a thorough understanding. It will be apparent, however, to one having ordinary skill in the art that the specific detail need not be employed to practice the present disclosure. In other instances, well-known materials or methods have not been described in detail in order to avoid obscuring the present disclosure.

Reference throughout the preceding specification to "one embodiment", "an embodiment", "one example" or "an example", "one aspect" or "an aspect" means that a particular feature, structure or characteristic described in connection with the embodiment or example is included in at least one embodiment of the present disclosure. Thus, appearances of the phrases "in one embodiment", "in an embodiment", "one example" or "an example", "one aspect" or "an aspect" in various places throughout this specification are not necessarily all referring to the same embodiment or example.

Furthermore, the particular features, structures, or characteristics may be combined in any suitable combinations and/or sub-combinations in one or more embodiments or examples. Where relevant, dimensions in millimetres in this application are cited to the nearest +–0.01 mm unless otherwise stated.

REFERENCE NUMERALS

| | |
|---|---|
| S | Shaving direction |
| SH | Shaving plane |
| CEP | Cutting edge plane CEP |
| L | Longitudinal direction |
| IBS | inter blade span |
| RO | inner radius of curvature |
| T1 | Razor blade thickness |
| T2 | Blade support thickness |
| 1 | Shaving razor assembly |
| 2 | Handle |
| 4 | proximal portions |
| 5a, 5b | release mechanism |
| 6 | distal portion |
| 7 | thumb rest |
| 8 | pivotable bearing member |
| 9 | handle grips |
| 12 | bulging |
| 14 | skin contact point |
| 16 | first side portion |
| 18 | second side portion |
| 19 | cutting member mounting portion |
| 20 | razor cartridge |
| 21 | housing |
| 22 | platform member |
| 23 | guard member |
| 24 | leading longitudinal side |
| 25 | trailing longitudinal side |
| 26 | first retainer |
| 27 | second retainer |
| 28a-d | cutting member |
| 29 | group of cutting members |
| 30a-d | cutting edge |
| 31a-d | blade receiving section |
| 32 | blade support |
| 33a-d | blade |
| 34a-d | holding slots |
| 35 | cross member |
| 36 | blade support guide |
| 38a-d | resilient finger |
| 40 | leading inter blade span |
| 41 | first intermediate inter blade span |
| 42 | trailing inter-blade span |
| 43a-d | cutting edge to blade span |
| 44 | leading blade to housing span |
| 45 | trailing blade to housing span |
| 46 | first debris run-off portion |
| 47 | second debris run-off portion |
| 48 | third debris run-off portion |
| 55 | internal leading longitudinal wall of blade receiving section 31 |
| 56 | internal trailing longitudinal wall of blade receiving section 31 |
| 65 | top side of blade support member |
| 64 | inner surface of blade support |
| 66 | outer surface of blade support |
| 70 | inner face of blade |
| 72 | rounded front end of blade support |

-continued

| | |
|---|---|
| 74 | obtaining a housing . . . |
| 76 | obtaining cutting members |
| 78 | assembling housing and cutting members |

Conventional razor cartridge with skin care element (FIG. 4):

| | |
|---|---|
| 90 | conventional razor cartridge comprising skin care element |
| 91 | leading longitudinal side |
| 92 | trailing longitudinal side |
| 93a-d | holding slots |
| 94 | housing |
| 95 | platform member |
| 96 | guard member |
| 97a-d | resilient finger |
| 98 | blade support guide |
| 99 | cross member |
| 100 | blade receiving section |
| 101 | trimming blade |
| 102 | first retainer |
| 103 | second retainer |
| 104 | skin care element (for example, lubricating strip) |
| 105a-d | cutting members |
| 106 | cutting blade |
| 107 | cutting edge |

The invention claimed is:

1. A razor cartridge comprising:

a housing extending along a longitudinal axis, wherein the housing comprises a leading longitudinal side and a trailing longitudinal side, and a cutting member mounting portion provided in between the leading longitudinal side and the trailing longitudinal side; and three or more substantially parallel cutting members disposed in the cutting member mounting portion in a shaving direction of the razor cartridge;

wherein each of the three or more cutting members comprises a blade support, wherein the blade support comprises a blade mounting portion disposed on an inner surface of the respective blade support that, in use, faces away from a shaving surface, and a blade attached to the blade mounting portion, wherein the cutting members are disposed to define a plurality of inter-blade spans between cutting edges of the blades, wherein the cutting edges of the blades define a cutting edge plane, wherein the blade support contacts the cutting edge plane and is arranged such that, in use, a distal end of the blade support and the cutting edge simultaneously contact the shaving surface, wherein the trailing longitudinal side of the housing does not comprise a lubrication strip, and wherein the distal ends of the blade supports define a support plane, and a distance between the cutting edge plane and the support plane is in a range from –80 um to +80 um.

2. The razor cartridge according to claim 1, wherein the distal end of the blade support and the cutting edge are arranged to reduce a force applied by the cutting edge and/or are arranged to evenly distribute a drag force.

3. The razor cartridge according to claim 1, wherein:

the plurality of inter-blade spans include a leading inter-blade span and a trailing inter-blade span, the leading inter-blade span is closer to the leading longitudinal side of the razor cartridge than the trailing inter-blade span, and the leading inter-blade span is greater than the trailing inter-blade span.

4. The razor cartridge according to claim 1, wherein the plurality of inter-blade spans include a leading inter-blade span and a trailing inter-blade span, wherein the leading inter-blade span is in a range from 1.80 mm to 2.00 mm and wherein the trailing inter-blade span is in a range from 1.50 mm to 1.65 mm.

5. The razor cartridge according to claim 1, further comprising:

a fourth substantially parallel cutting member disposed in the cutting member mounting portion between the leading and trailing longitudinal sides of the razor cartridge in the shaving direction of the razor cartridge, wherein the plurality of inter-blade spans include a leading inter-blade span and a trailing inter-blade span, and a first intermediate inter-blade span is further defined between the leading inter-blade span and the trailing inter-blade span.

6. The razor cartridge according to claim 5, wherein the first intermediate inter-blade span is equal to, or less than, the leading inter-blade span.

7. The razor cartridge according to claim 5, wherein the first intermediate inter-blade span is equal to, or greater than, the trailing inter-blade span.

8. The razor cartridge according to claim 5, wherein the first intermediate inter-blade span is in a range from 1.60 mm to 1.80 mm.

9. The razor cartridge according to claim 5, wherein one or more of the leading inter-blade span, the first intermediate inter-blade span, and/or the trailing inter-blade span is in a range from 1.75 mm to 1.95 mm.

10. The razor cartridge according to claim 1, wherein, for at least one of the three or more cutting members, the blade and the blade support are integrally formed to have the cutting edge, a base portion of the blade support extending along a base portion plane, and a curvilinear portion of the blade support intermediate the cutting edge and the base portion.

11. A shaving razor assembly comprising:

a razor handle; and a razor cartridge according to claim 1, wherein the razor cartridge is either releasably attached to the razor handle via a pivotable or non-pivotable connection, integrally formed with the razor handle via a non-pivotable connection, or integrally formed with the razor handle via a pivotable connection.

12. A kit of parts comprising:

a razor handle; and a plurality of razor cartridges according to claim 1.

13. The razor cartridge of claim 1, further comprising:

a fourth substantially parallel cutting member disposed in the cutting member mounting portion between the leading and trailing longitudinal sides of the housing in the shaving direction of the razor cartridge, wherein:

each blade support has a thickness in a range from 0.155 mm to 0.185 mm, the distal ends of the blade supports define a support plane, a distance between the cutting edge plane and the support plane is in a range from −80 um to +80 um, a distance, in a direction parallel to the cutting edge plane, between the distal end of the blade support and the cutting edge is in a range from 0.3 mm to 0.6 mm, the plurality of inter-blade spans include a leading inter-blade span, a trailing inter-blade span, and an intermediate inter-blade span between the leading inter-blade span and the trailing inter-blade span, the trailing inter-blade span is in a range from 1.75 mm to 1.95 mm, the leading inter-blade span is in a range from 1.80 mm to 2.00 mm, the intermediate inter-blade span is in a range from 1.55 mm to 1.95 mm, a span defined between a rearmost portion of a rearmost one of the substantially parallel cutting members that is closest to the trailing longitudinal side and a rearmost portion of the trailing longitudinal side of the housing is less than 2.35 mm, and a total span of the cutting member mounting portion is in a range from 7 to 15 mm.

14. A razor cartridge comprising:

a housing extending along a longitudinal axis, wherein the housing comprises a leading longitudinal side, a trailing longitudinal side, and a cutting member mounting portion provided in between the leading longitudinal side and the trailing longitudinal side; and three or more substantially parallel cutting members disposed in the cutting member mounting portion in a shaving direction of the razor cartridge;

wherein each of the cutting members comprises a blade support, wherein the blade support comprises a blade mounting portion disposed on an inner surface of the respective blade support that, in use, faces away from a shaving surface, and a blade attached to the blade mounting portion, wherein the cutting members are disposed to define a plurality of inter-blade spans between cutting edges of the blades, wherein the cutting edges of the blades define a cutting edge plane, wherein each of the blade supports contacts the cutting edge plane, wherein distal ends of the blade supports define a support plane, and a distance between the cutting edge plane and the support plane is in a range from −80 um to +80 um, and wherein a span defined between a rearmost portion of a rearmost one of the substantially parallel cutting members that is closest to the trailing longitudinal side and a rearmost portion of the trailing longitudinal side of the housing is less than 2.35 mm.

15. The razor cartridge according to claim 14, wherein the trailing longitudinal side of the housing does not comprise a skin care element.

16. The razor cartridge according to claim 14, wherein a radius bend portion of the blade support is rounded to have a predetermined radius of curvature that is less than 0.9 mm.

17. The razor cartridge according to claim 14, wherein a leading inter-blade span of the plurality of inter-blade spans is in a range from 1.80 mm to 2.00 mm, wherein a trailing inter-blade span of the plurality of inter-blade spans is in a range from 1.50 mm to 1.65 mm, and wherein a cutting edge to blade span is defined between the distal end of the blade support and the cutting edge in a direction parallel to the cutting edge plane, the cutting edge to blade span is in a range from 0.3 mm to 0.6 mm, and wherein at least one cutting member among the three or more cutting members has a different cutting edge to blade span than the remaining cutting members among the three or more cutting members.

18. The razor cartridge of claim 14, wherein the span defined between a rearmost portion of a rearmost one of the substantially parallel cutting members and a rearmost portion of the trailing longitudinal side of the housing is less than 1.95 mm.

19. A method of manufacturing a razor cartridge comprising:

obtaining a housing extending along a longitudinal axis, wherein the housing comprises a leading longitudinal side, a trailing longitudinal side, and a cutting member mounting portion provided in between the leading longitudinal side and the trailing longitudinal side;

obtaining three or more substantially parallel cutting members; and assembling the housing and the three or more substantially parallel cutting members in the cutting member mounting portion of the housing between the leading longitudinal side and the trailing longitudinal side of the housing in a shaving direction of the razor cartridge;

wherein each of the cutting members comprises a blade support comprising a blade mounting portion disposed on an inner surface of the respective blade support and a blade attached to the blade mounting portion, wherein the cutting members are disposed to define a plurality of inter-blade spans between cutting edges of the blades;

wherein the cutting edges of the blades define a cutting edge plane, wherein each of the blade supports contacts the cutting edge plane, wherein distal ends of the blade supports define a support plane, and a distance between the cutting edge plane and the support plane is in a range from −80 μm to +80 μm.

* * * * *